US006307947B1

(12) United States Patent
Wiener

(10) Patent No.: US 6,307,947 B1
(45) Date of Patent: Oct. 23, 2001

(54) LOW PROFILE SPEAKER ENCLOSURE

(76) Inventor: David Wiener, 10 Iron Canyon Ct., Park City, UT (US) 84060

( * ) Notice: Subject to any disclaimer, the term of this patent is extended or adjusted under 35 U.S.C. 154(b) by 0 days.

(21) Appl. No.: 09/516,721

(22) Filed: Mar. 1, 2000

(51) Int. Cl.[7] ..... H04R 1/02

(52) U.S. Cl. ..... 381/386; 381/345; 381/152; 181/156; 181/150

(58) Field of Search ..... 381/152, 182, 381/332, 333, 334, 337, 338, 339, 345, 353, 354, 372, 374, 386, 388, 431, FOR 145, FOR 146; 181/148, 150, 151, 156, 198, 199

(56) References Cited

U.S. PATENT DOCUMENTS

| | | | | |
|---|---|---|---|---|
| 4,509,184 | | 4/1985 | Yanagawa | 381/24 |
| 4,549,631 | | 10/1985 | Bose | 181/155 |
| 4,778,027 | | 10/1988 | Taylor | 181/175 |
| 4,899,390 | | 2/1990 | Takewa et al. | 381/154 |
| 4,903,300 | | 2/1990 | Polk | 381/24 |
| 4,923,032 | | 5/1990 | Nuernberger | 181/150 |
| 4,926,487 | | 5/1990 | Yoshida et al. | 381/186 |
| 5,036,946 | * | 8/1991 | Yoshino | 181/156 |
| 5,335,284 | | 8/1994 | Lemons | 381/152 |
| 5,359,158 | | 10/1994 | Queen | 181/150 |
| 5,710,395 | * | 1/1998 | Wilke | 181/156 |
| 5,883,966 | | 3/1999 | Kubo | 381/386 |

OTHER PUBLICATIONS

Copies of Web pages on Infinitysystems.com for flat panel and ERS Series of in–wall loudspeakers, Mar. 2000, 10 pages.

* cited by examiner

*Primary Examiner*—Sinh Tran
(74) *Attorney, Agent, or Firm*—David P Gordon; David S Jacobson; Thomas A Gallagher

(57) ABSTRACT

A low profile speaker enclosure for mounting on a structure including a speaker housing and an electroacoustical transducer is disclosed. The speaker housing has a front face and a back each defining a length and a width, and a plurality of sides substantially separating the front face and the back and defining a thickness of the speaker housing. In the preferred embodiment, the front face and the back are substantially parallel. The front face, the back, and the plurality of sides of the speaker housing substantially define a chamber. The front face defines a speaker aperture opening into the chamber. The electroacoustical transducer is mounted in the speaker aperture. At least one of the sides defines a side aperture. The back of the low profile speaker enclosure defines a channel and defines a back aperture providing an opening between the channel and the chamber. The side aperture is also defined by the channel. The structure at least partially encloses the channel and provides a pathway between the chamber and an exterior environment for increased acoustic performance.

22 Claims, 12 Drawing Sheets

LOW PROFILE SPEAKER ENCLOSURE

BACKGROUND OF THE INVENTION

1. Field of the Invention

This invention relates broadly to acoustical speakers. More particularly, this invention relates to low profile speaker enclosures.

2. State of the Art

Audio and video equipment is quickly becoming smaller as demand for more compact and more portable audio and video equipment (such as flat screen televisions and flat screen computer monitors) increases. Likewise, speaker components are being designed into smaller electronic equipment including computers, telephones, and even watches, and are shrinking in size to be more adaptably placeable within rooms. Audiophiles and videophiles are more often hooking up their video equipment to audio systems and placing speakers completely around a room to provide a surround sound effect. However, the conventional speakers are often bulky and take up valuable floor space. Even when mounted on a wall, the speakers are large and conspicuous, and undesirably protrude into a room. Therefore, audiophiles and videophiles seek audio and video equipment which is either inconspicuous within an environment or which can easily be hidden or concealed so that it does not disturb the decor of the environment. However, sound quality in the mid- and lower frequency ranges remain an ever important consideration when designing smaller speakers, as smaller enclosures typically result in reduced low frequency output.

Typical speaker enclosures often have sound ports which increase low frequency output. A sound port is an opening typically within the front face or the back of the speaker enclosure which passively emits relatively low frequency sound and provides the speaker with a greater frequency range. Sound ports formed in small enclosures are typically ineffective due to the difficulty of creating an effective port opening or port volume without sacrificing either the advantageous resonance properties of the enclosure or the structural integrity of the enclosure. Further, the small dimensions of compact enclosures makes it difficult to create an opening for a port which avoids whistling and whooshing noises due to sound vibration and air turbulence within the enclosure.

U.S. Pat. No. 4,903,300 to Polk discloses a compact speaker enclosure sized to be installed within a structural partition, such as within an existing wall cavity between standard wall studs. The speaker enclosure has a relatively small resonance chamber volume. In order to increase frequency response especially in the low frequency range, the speaker enclosure is ported such that it utilizes the cavity between the studs as an integral part of the resonance chamber, thereby reducing the required speaker enclosure volume and thereby reducing the required speaker enclosure size and thickness. While utilizing the pre-existing cavity between the wall studs allows for a reduced chamber volume requirement and allows the speaker enclosure to be formed considerably smaller than conventional speaker enclosures, it also requires that the speakers be installed preferably prior to installation of the sheetrock. Alternately, it entails making significant post-construction modifications to the existing wall (i.e. requiring a carpenter to cut a large enough hole in the existing sheetrock to fit the entire speaker enclosure through into the cavity, wire the speaker and mount it to the wall studs or rear partition within the wall cavity, and then repair the wall and paint). Further, if the speaker is to be installed within an exterior wall, the portion of the wall housing the speaker enclosure and forming a part of the resonance chamber must have the wall insulation removed prior to installation. This results in significant energy loss and cold pockets throughout the space, thereby adding to heating and cooling costs. Further, the speaker of Polk is only usable within walls which are hollow, i.e. walls formed from studs forming hollow channels, and not, e.g., in cement block walls.

SUMMARY OF THE INVENTION

It is therefore an object of the invention to provide a low profile speaker enclosure which has desirable sound reproduction characteristics.

It is another object of the invention to provide a low profile speaker enclosure having an effective port.

It is a further object of the invention to provide a low profile speaker enclosure which can be easily and economically formed.

It is an additional object of the invention to provide a low profile speaker enclosure which can be adapted for use and mounting in many applications.

According to one embodiment of the invention, a low profile speaker enclosure including a speaker housing and an electroacoustical transducer is provided. The speaker housing has a front face and a back each defining a length and a width, and a plurality of sides defining a thickness and at least partially separating the front face and the back. In the preferred embodiment, the front face and the back of the speaker housing are substantially parallel, and the thickness of the housing is substantially less than either of the length or the width of the housing.

The front face, the back, and the plurality of sides of the speaker housing substantially define a chamber. The front face defines a speaker aperture which opens into the chamber, and an electroacoustical transducer is mounted in the speaker aperture. At least one of the sides defines a side aperture. The back of the low profile speaker enclosure has a first portion and a second portion which together define a back aperture therebetween which opens to the chamber. The second portion of the back defines a channel having at one end the back aperture and at the other end the side aperture, thereby forming a port in the speaker. When the speaker is mounted on a mounting surface, e.g., a wall, the mounting surface and the second portion of the back substantially enclose the channel to form a pathway or port between the back aperture into the chamber and an external environment.

In the preferred embodiment, the housing length is at least ten times greater than the housing thickness, and the width is at least five times greater than the housing thickness. The speaker enclosure is preferably integrally molded from a rigid plastic, but also may be made from resins, wood, or composites. Further, the front face, side faces, and portions of the back face of the speaker enclosure may be formed having an undulating shape to reduce standing waves within the chamber.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1A:
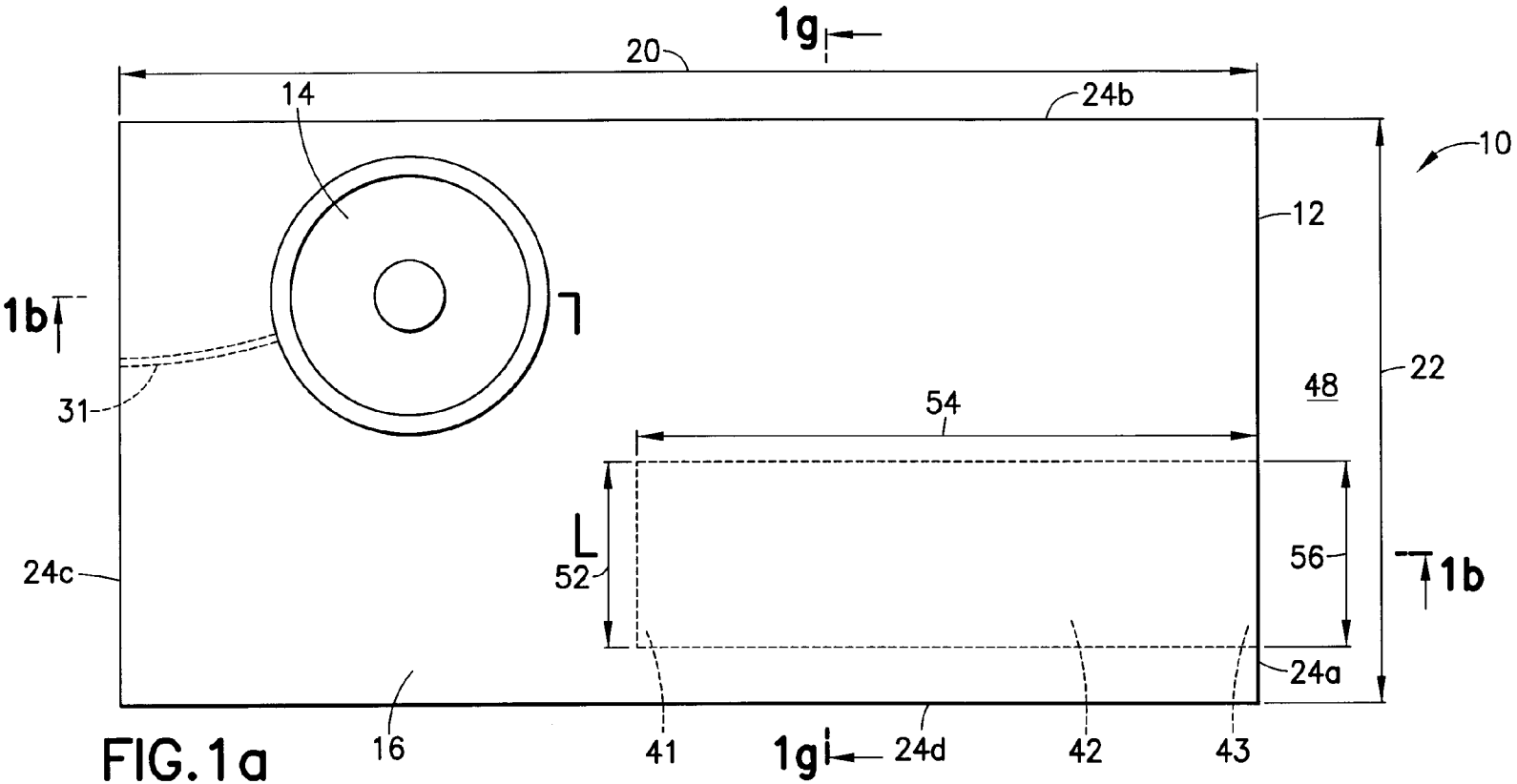
FIG. 1*a* is a top view of a first embodiment of a low profile speaker enclosure.
Figure 1B:
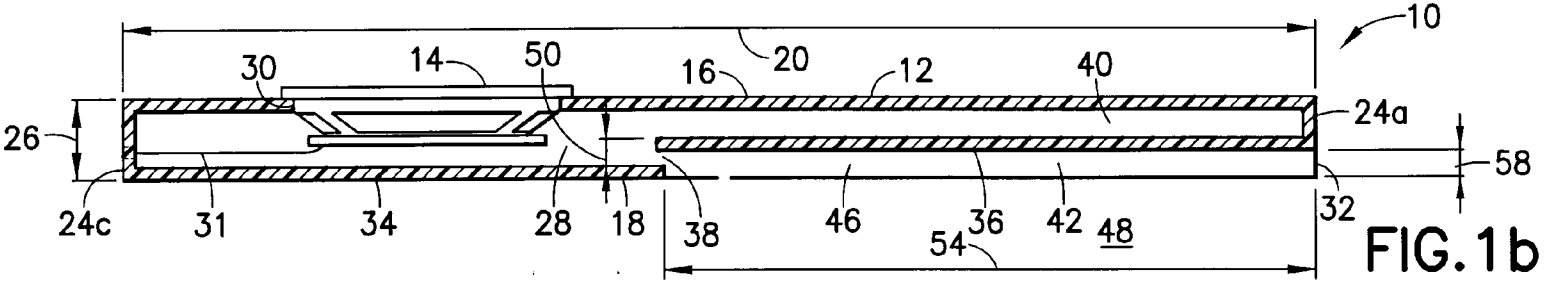
FIG. 1*b* is a partial cross-sectional view of the low profile speaker enclosure of FIG. 1*a* taken along line 1*b*—1*b;*
Figure 1C:
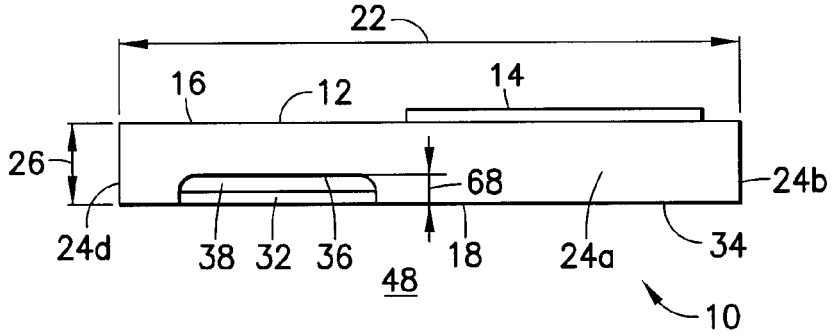
FIG. 1*c* is a side view of the first embodiment of the low profile speaker enclosure of FIG. 1*a;*
Figure 1D:
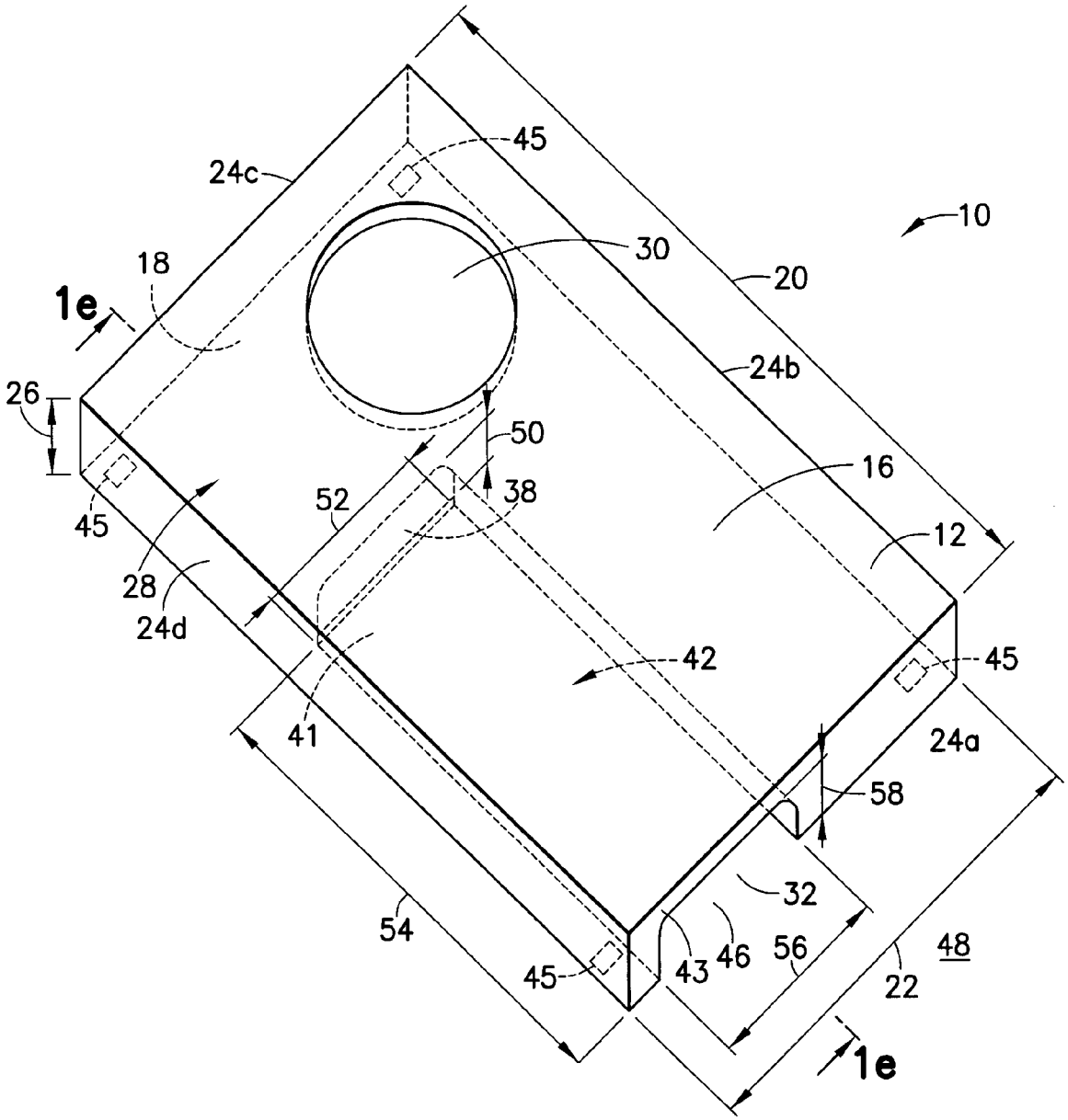
FIG. 1*d* is a perspective view of the first embodiment of the low profile speaker enclosure o f FIG. 1*a;*
Figure 1E:
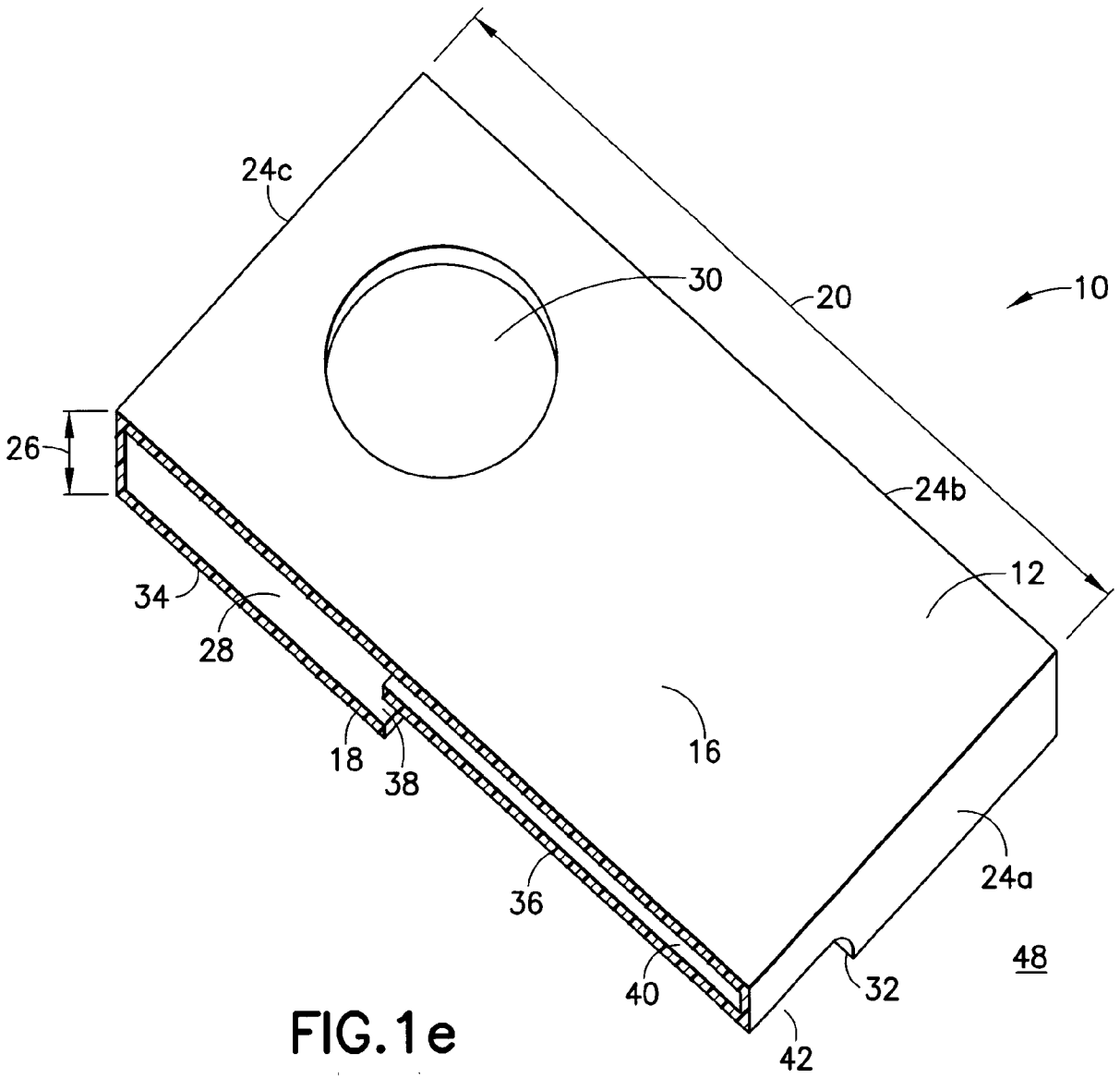
FIG. 1*e* is a perspective sectional view of the first embodiment of the low profile speaker enclosure taken along line 1*e*—1*e* of FIG. 1*d;*
Figure 1F:
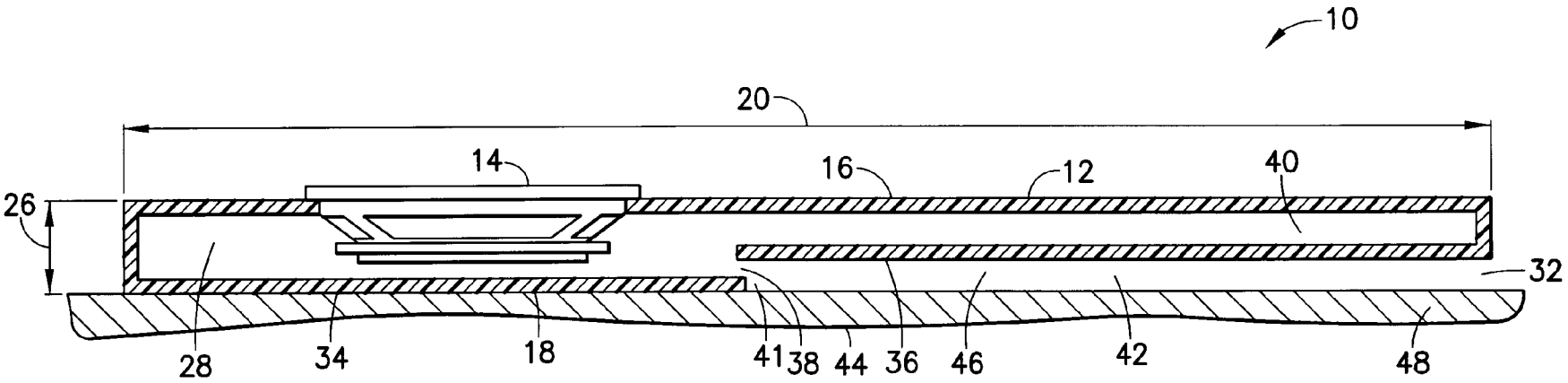
FIG. 1*f* is a broken partial cross-sectional view of the low profile speaker enclosure similar to FIG. 1*b*, with the speaker mounted on a structure.
Figure 1G:
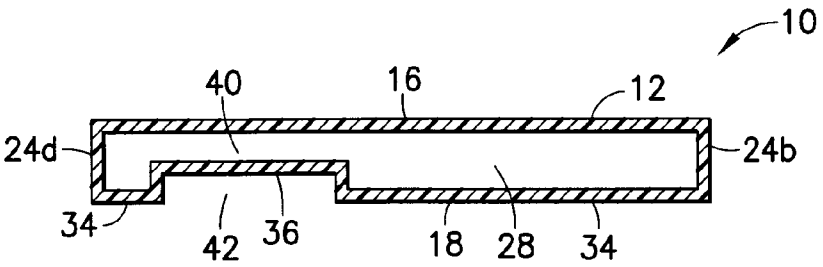
FIG. 1*g* is a cross-sectional view of the low profile speaker enclosure of FIG. 1*a* along line 1*g*—1*g;*

Turning now to FIGS. 1*a*, 1*b*, 1*c*, 1*d*, 1*e*, 1*f*, and 1*g*, a first embodiment of a low profile speaker enclosure 10 including a speaker housing 12 and an electroacoustical transducer 14 is shown. The speaker housing 12 has a front face 16 and a back 18 each defining a length 20 and a width 22, and a plurality of sides 24*a*, 24*b*, 24*c*, 24*d* defining a thickness 26 of the housing 12 and at least partially separating the front face 16 and the back 18. In the first embodiment 10, the thickness 26 of the housing 12 is preferably substantially less than either of the length 20 or the width 22.

The front face 16, the back 18, and the plurality of sides 24*a*, 24*b*, 24*c*, 24*d* of the speaker housing 12 substantially define a chamber 28. The front face 16 defines a speaker aperture 30 which opens into the chamber 28 and into which the electroacoustical transducer 14 is mounted. The electroacoustical transducer 14, which is preferably a cone speaker and magnet, may be coupled by wires 31 to speaker jacks (not shown) which may be coupled to an amplifier (not shown). At least one of the sides 24*a* of the housing 12 defines a side aperture 32. The back 18 of the speaker enclosure 10 has a first portion 34 and a second portion 36 defining a back aperture 38 at least partially therebetween. The back aperture 38 opens to the chamber 28. Both the side aperture 32 and the back aperture 38 are preferably non-circular, and more preferably u-shaped. However, the side and back apertures 32, 38 need not be identically shaped or sized.

According to the first embodiment, the front face 16 of the speaker enclosure 10 is substantially formed along a first plane and the first portion 34 of the back 18 is substantially formed along a second plane which is preferably parallel to the first plane. At least part of the second portion 36 of the back 18 lies outside the second plane and causes the chamber 28 to have a narrow portion 40. The second portion 36 of the back 18 defines a channel 42 having at a first end 41 the back aperture 38, and at a second end 43 the side aperture 32. The generally planar first portion 34 allows for easy mounting of the speaker enclosure 10 upon a substantially flat surface or structure 44 such as on a wall. When the speaker enclosure 10 is mounted to a structure 44, the back aperture 38, the side aperture 32, the channel 42 and the structure 44 together define a port 46 which provides a pathway between the chamber 28 and an exterior environment 48 which permits the low profile speaker enclosure 10 to provide excellent sound quality especially in the lower frequencies. The speaker enclosure 10 may be removably mounted to the structure 44 by securing means such as screws, hooks, double-sided tape, hook-and-loop tape such as VELCRO®, adhesives, picture hangers, wire or other securing devices, all designed to seal the speaker against the mounting surface. Further, the speaker enclosure 10 may be provided with openings 45 adapted to accept the head of a screw (not shown).

According to the first embodiment, the length 20 of the housing 12 is preferably between six and twenty-four inches, the width 22 between six and twenty-four inches, and the thickness 26 between 0.25 and 4 inches. The preferred thickness of between 0.25 and 4 inches has been determined to be the most advantageous size for inconspicuous use in the widest variety of applications. Further, the length 20 of the housing 12 is preferably at least ten times greater than the thickness 26 of the housing 12, and the width 22 is preferably at least five times greater than the thickness 26 of the housing 12. The narrow profile of the speaker enclosure 10 gives it greater versatility in the selection of locations and applications on which it might be used.

By way of example only, for a speaker enclosure of twenty-four inches long, by twelve inches wide, by one inch thick, the back aperture 38 may have a height 50 between 0.25 and 0.50 inches, and a width 52 between two and four inches. The length 54 of the channel 42 is might between three and sixteen inches, and the width 56 of the channel 42 is might be between two and four inches. The width 56 of the side aperture 32 might be between two and four inches. The height 58 of the side aperture 32 might be between 0.25 and 0.50 inches. A speaker cone 14 of 5.25 inches 0 in diameter (an inverted motor, low-profile driver or flat diaphragm driver) could be utilized, and the resulting volume (not shown) of the chamber 28 provided to the 5.25 inch speaker cone 14 would between 286.5 and 256 cubic inches. It will be appreciated that exact aperture and port dimensions as well as enclosure volumes should be tuned to the particular speaker drivers utilized as well as specific performance desired. Thus, the dimensions and volumes discussed are by way of example only, and not by way of limitation.

The speaker enclosure 10 is preferably integrally molded from a rigid plastic, or from wood, resins, or composites, but may instead be formed in pieces for easier dismantling and storage. It should be appreciated that a one piece molded unit is simply and easily made inexpensively.

Figure 2A:
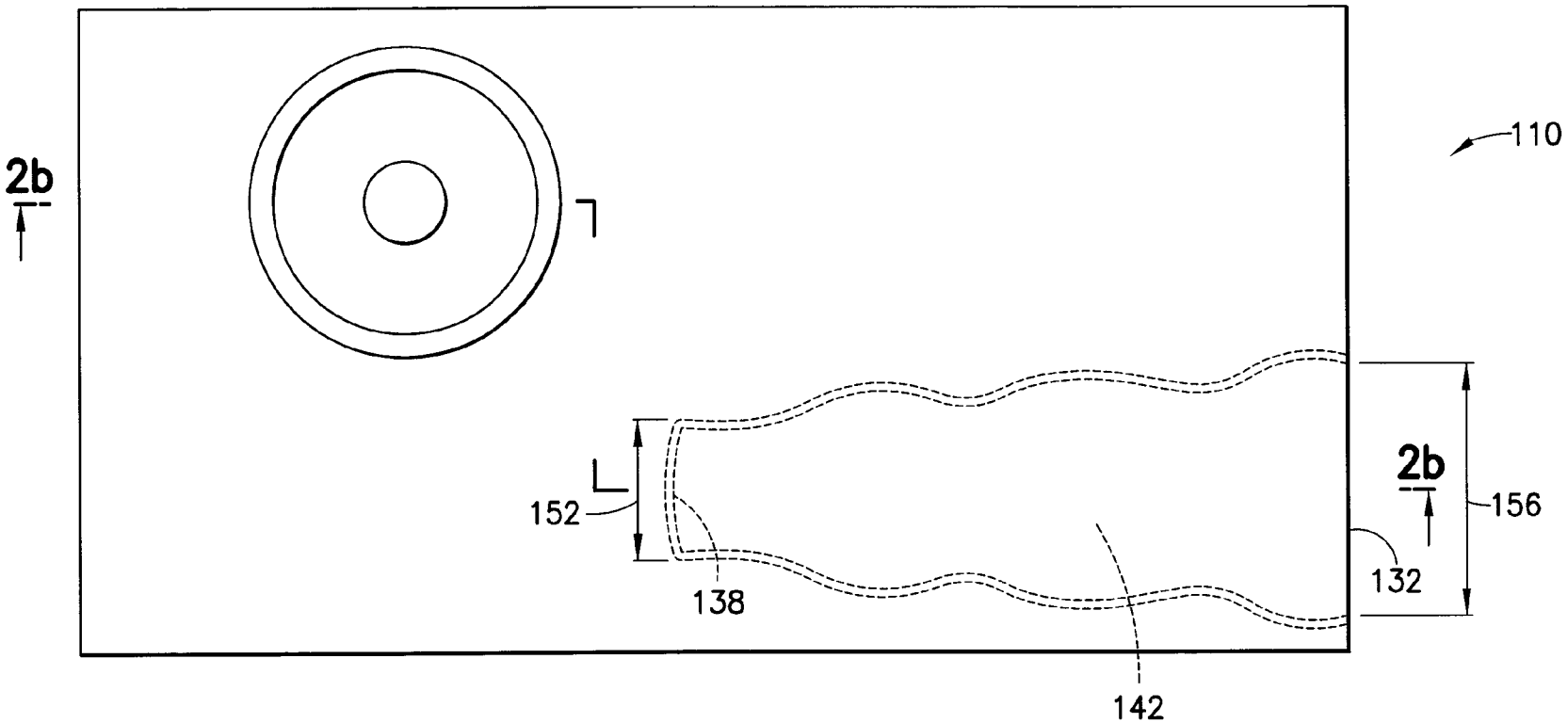
FIG. 2*a* is a top view of a second embodiment of a low profile speaker enclosure.
Figure 2B:
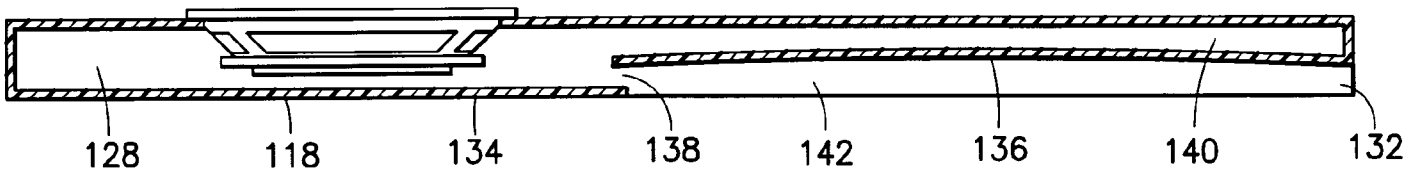
FIG. 2*b* is a partial cross-sectional view of the second embodiment of the low profile speaker enclosure of FIG. 2*a* taken along line 2*b*—2*b;*
Figure 2C:
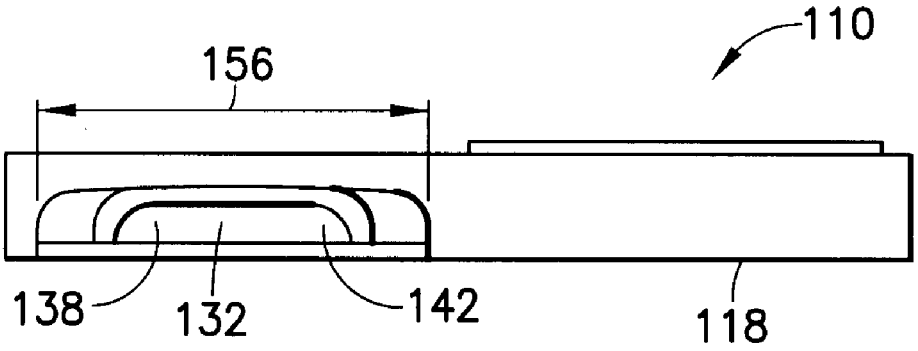
FIG. 2*c* is a side view of the second embodiment of the low profile speaker enclosure of FIG. 2*a;*

Turning now to FIGS. 2*a*, 2*b*, and 2*c*, a second embodiment of a low profile speaker enclosure 110, which is substantially similar to the first embodiment 10 (with like parts having reference numerals incremented by 100), is shown. In the second embodiment, the second portion 136 of the back 118 forming the channel 142 has an undulating form which helps breaks up standing waves both within the channel 142 and within the chamber 128. If desired, the second portion 136 of the back 118 may also be curvilinear or have an undulating form in a second dimension so that the narrow portion 140 of the chamber 128 increases and decreases in height. As with the previous embodiment, the channel 142 of the second embodiment is at least partially enclosed by the wall or mounting structure. Further, in the second embodiment, the width 152 of the back aperture 138 is preferably significantly smaller than the width 156 of the side aperture 132.

Figure 3C:
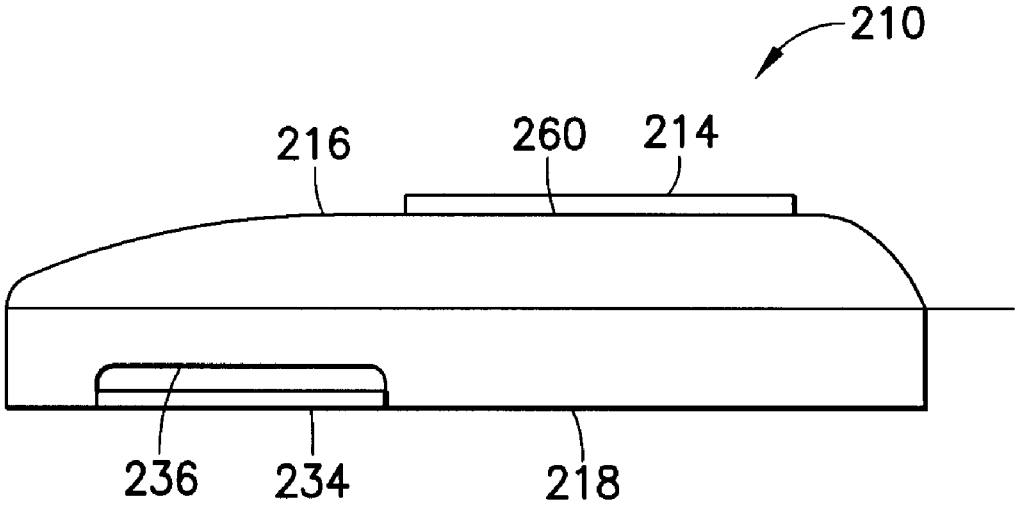
FIG. 3*c* is a side view of the third embodiment of the low profile speaker enclosure of FIG. 3*a;*
Figure 3A:
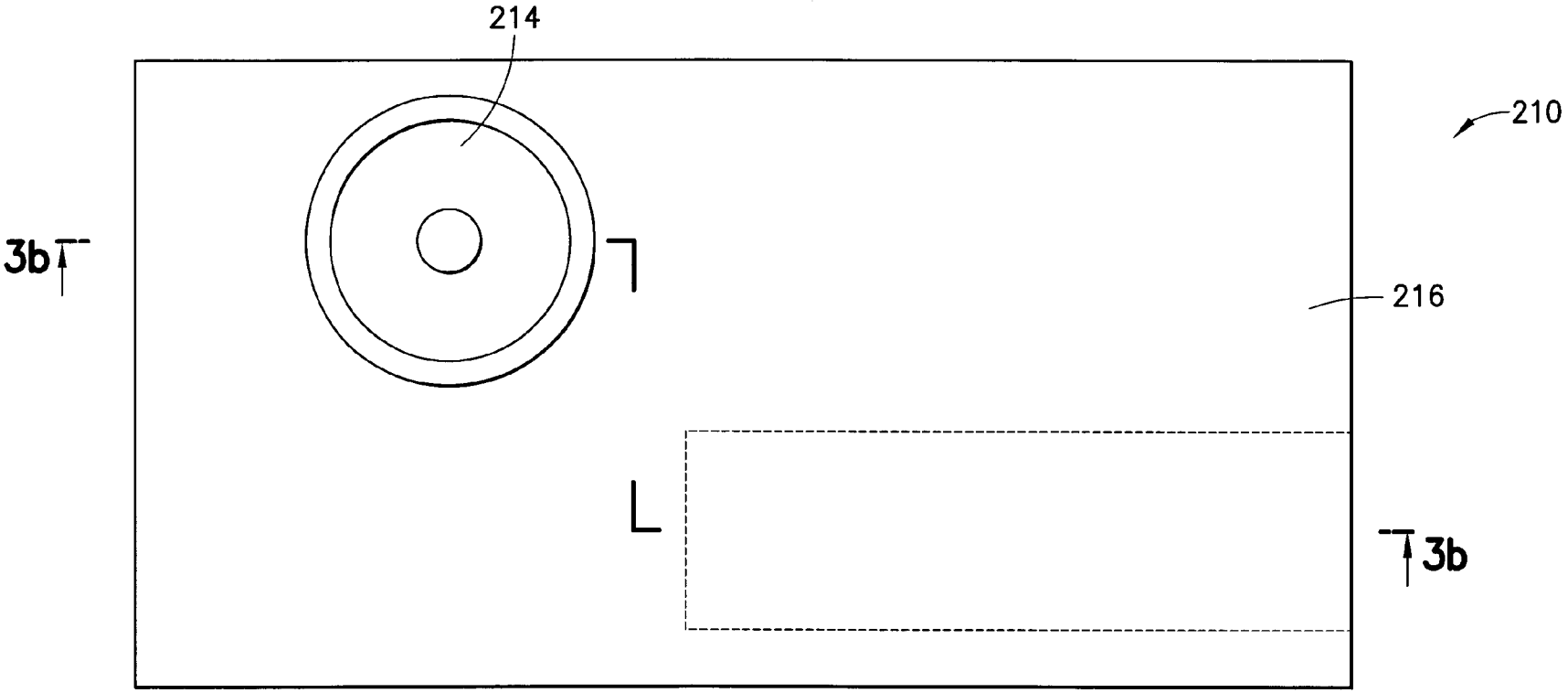
FIG. 3*a* is a top view of a third embodiment of a low profile speaker enclosure having a curvilinear front face.
Figure 3B:
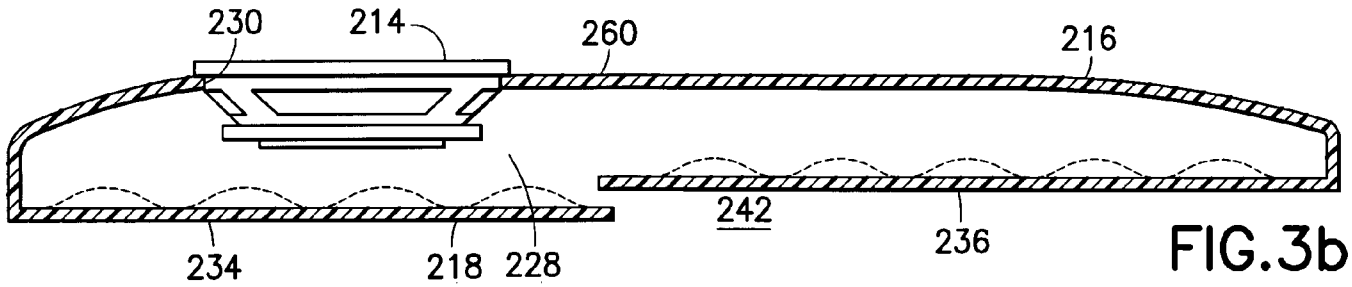
FIG. 3*b* is a partial cross-sectional view of the third embodiment of the low profile speaker enclosure taken along line 3*b*—3*b* in FIG. 3*a;*

Turning now to FIGS. 3*a*, 3*b*, and 3*c*, a third embodiment of a low profile speaker enclosure 210, which is substantially similar to the first embodiment 10 (with like parts having reference numerals incremented by 200), is shown. According to the third embodiment, the back 218 defines a channel 242 having a channel length 254 and having a back aperture 238 providing an opening between the chamber 228 and the channel 242. The side aperture 232 also opens into the channel 242. The generally planar back 218 allows for easy mounting of the speaker enclosure 210 upon a substantially flat surface or structure 244 such as to a wall. When the speaker enclosure 210 is mounted to the structure 244, the structure 244 at least partially encloses the channel 242 and provides an enclosed pathway between the chamber 228 and an exterior environment 248 which permits the low profile speaker enclosure 210 to provide excellent sound quality especially in the lower-frequencies. Further, the front face 216 of the third embodiment 210 has a gradual yet substantially curvilinear form, while the first portion 234 of the back 218 remains substantially planar. The speaker aperture 230 is preferably formed in a substantially flat section 260 of the curvilinear front face 216 such that the electroacoustical transducer 214 remains-facing substantially forward. The curvature of the front face 216 adds extra volume to the chamber 228, thereby providing enhanced sound quality while still maintaining a relatively low profile.

If desired, and as shown in phantom lines in FIG. 3*b*, the inner surface of the back wall 234 (including the portion 236 which helps form the channel 242) may be provided with a wavy or undulating form for reducing standing waves. In fact, other (and all) inner and outer surfaces of the speaker enclosure may be provided with an undulating form if desired.

Figure 4:
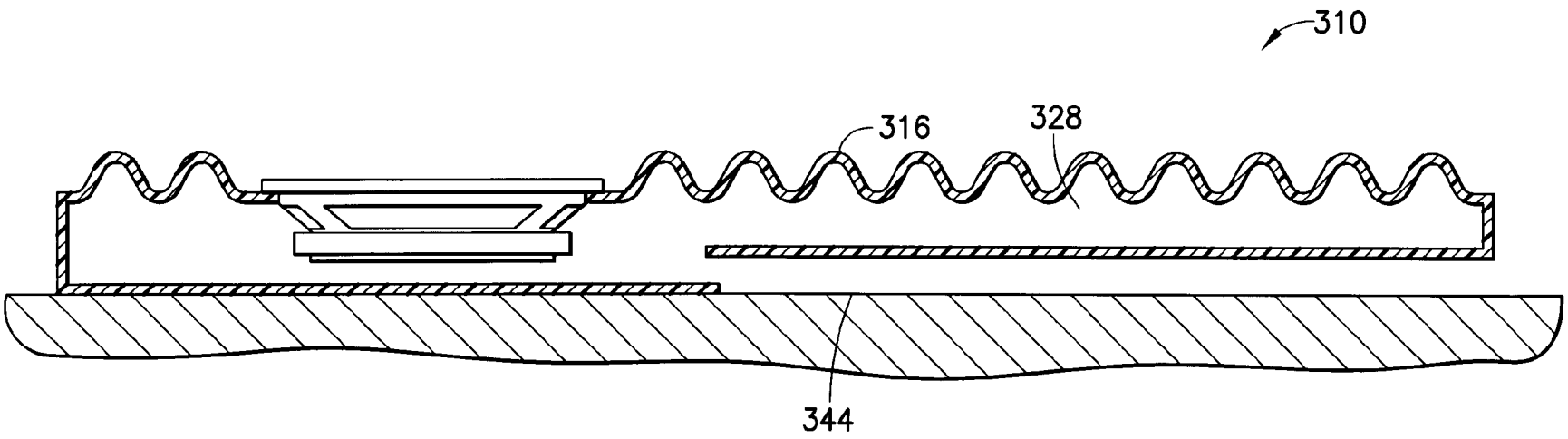
FIG. 4 is a broken partial cross-sectional view of a fourth embodiment of a low profile speaker enclosure having an undulating front face.

Turning now to FIG. 4, a fourth embodiment of a low profile speaker enclosure 310, which is substantially similar to the first embodiment 10 (with like parts having reference numerals incremented by 300), is shown mounted to a structure 344. The front face 316 of the fourth embodiment 310 has an undulating form which reduces standing waves within the chamber 328.

Figure 5A:
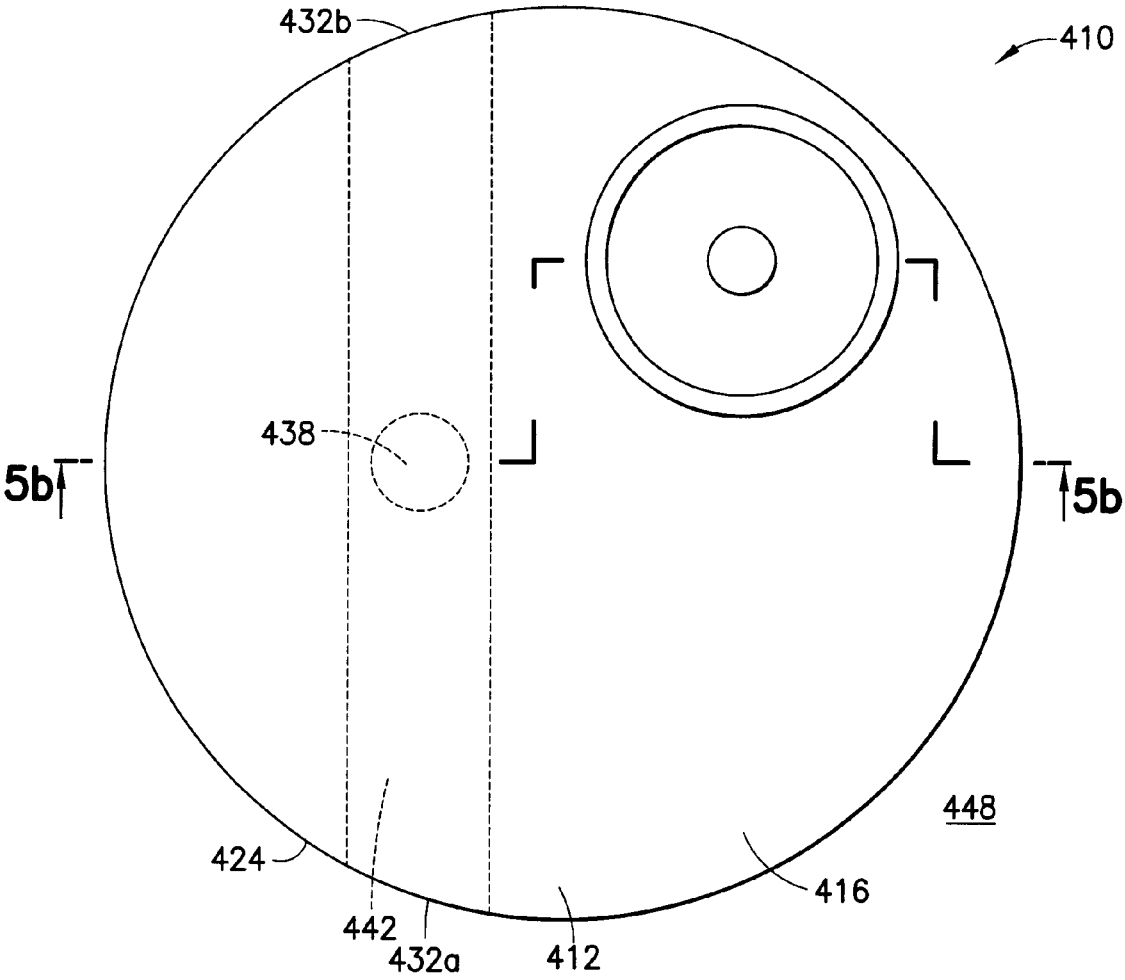
FIG. 5*a* is a top view of a fifth embodiment of a low profile speaker enclosure.
Figure 5B:
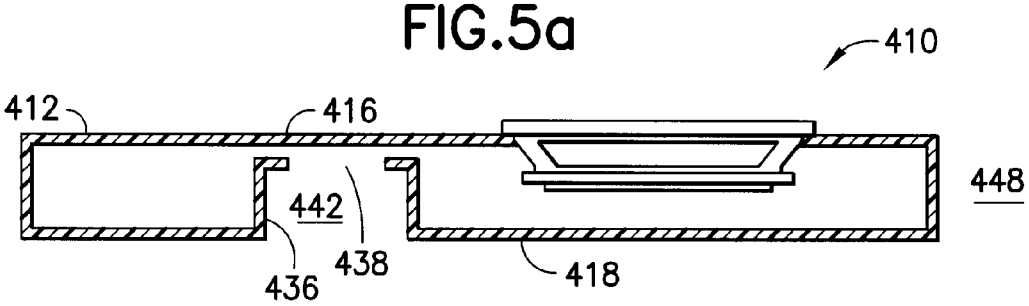
FIG. 5*b* is a partial cross-sectional view of the low profile speaker enclosure of FIG. 5*a* taken along line 5*b*—5*b;*
Figure 5C:
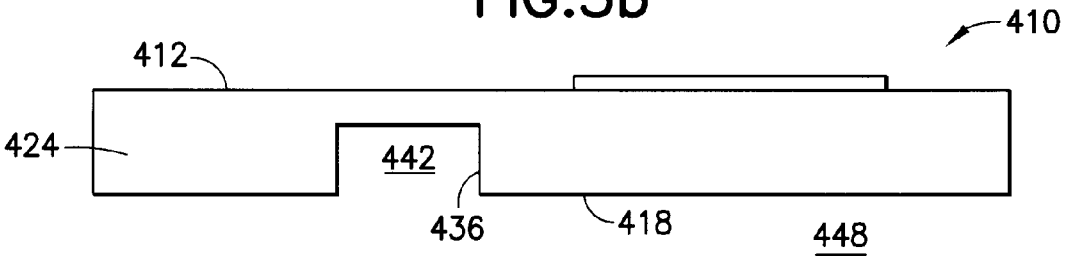
FIG. 5*c* is a side view of the fifth embodiment of the low profile speaker enclosure of FIG. 5*a;*
Figure 6A:
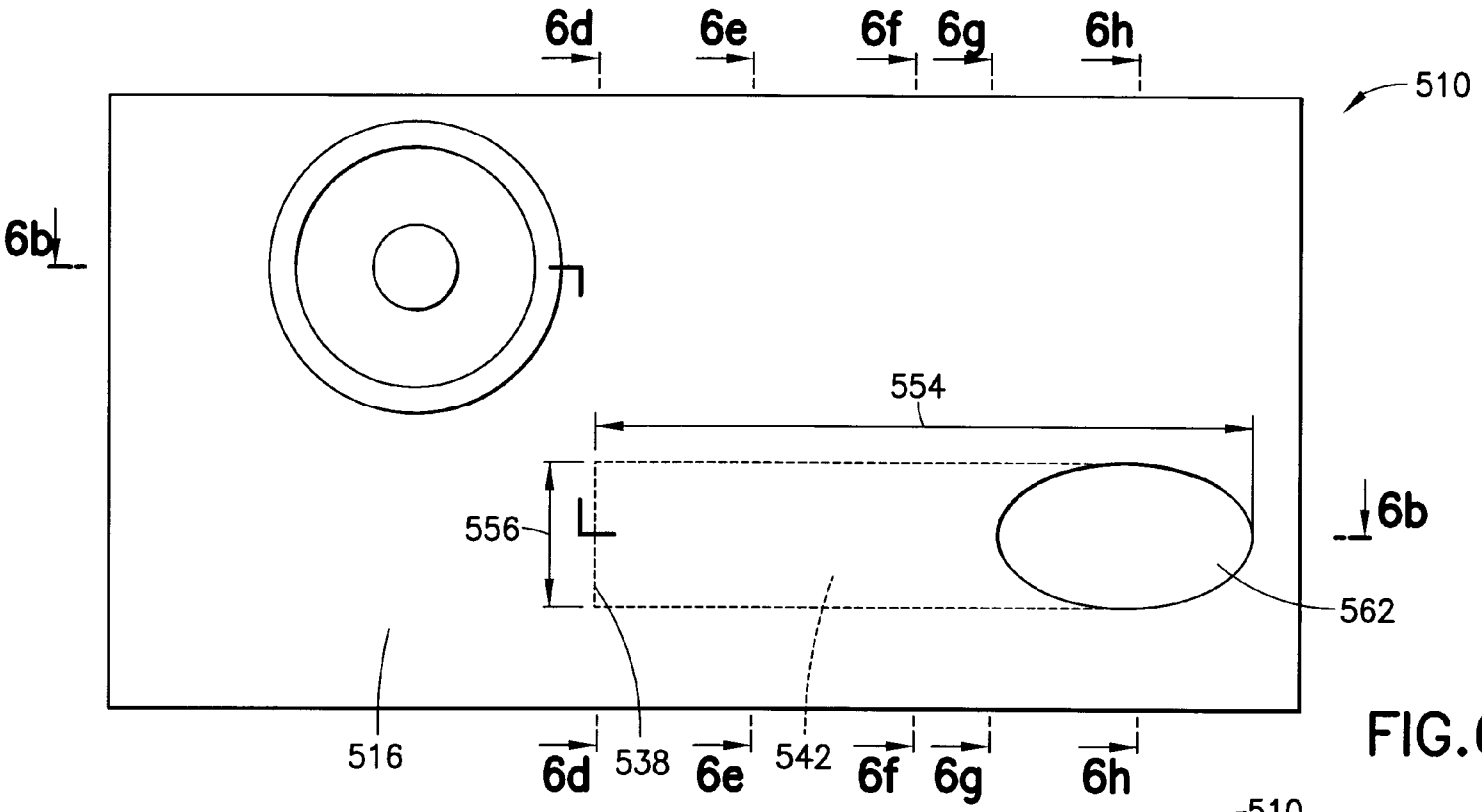
FIG. 6*a* is a top view of a sixth embodiment of a low profile speaker enclosure.
Figure 6B:
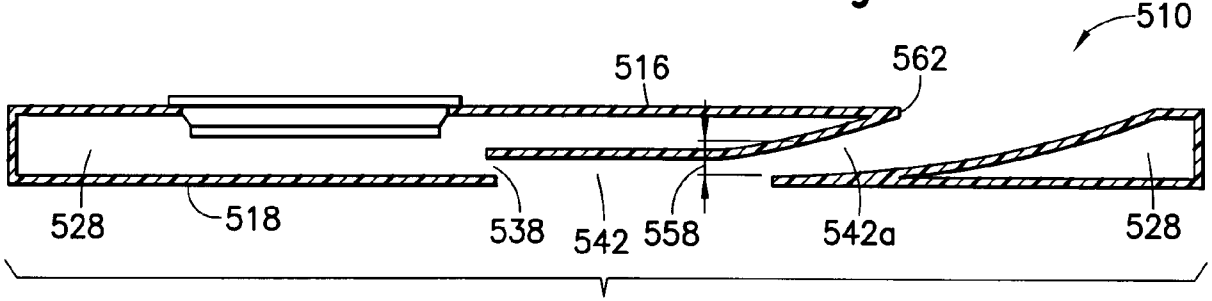
FIG. 6*b* is a partial cross-sectional view of the low profile speaker enclosure of FIG. 6*a* taken along line 6*b*—6*b;*
Figure 6C:
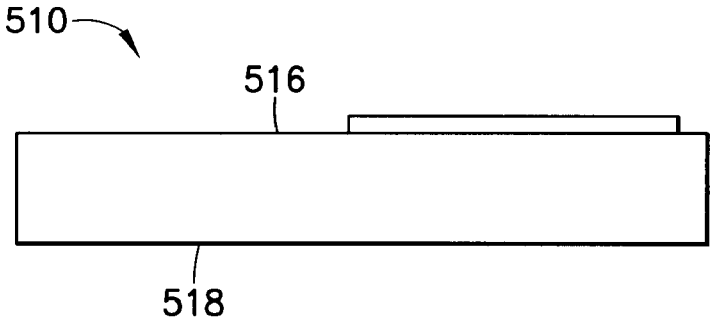
FIG. 6*c* is a side view of the sixth embodiment of the low profile speaker enclosure of FIG. 6*a;*
Figure 6D:
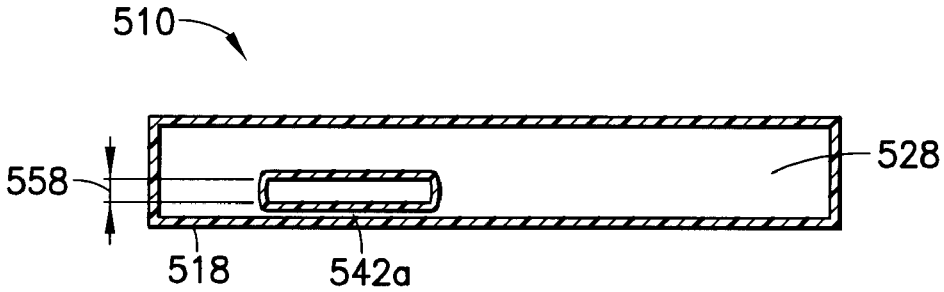
FIG. 6*d* is a cross-sectional view of the sixth embodiment of FIG. 6*a* taken along line 6*d*—6*d;*
Figure 6E:
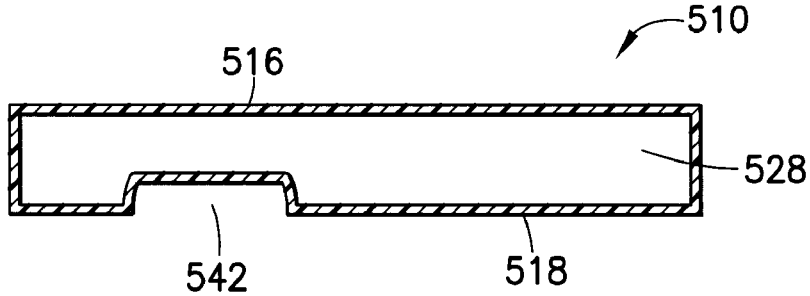
FIG. 6*e* is a cross-sectional view of the sixth embodiment of FIG. 6*a* taken along line 6*e*—6*e;*
Figure 6F:
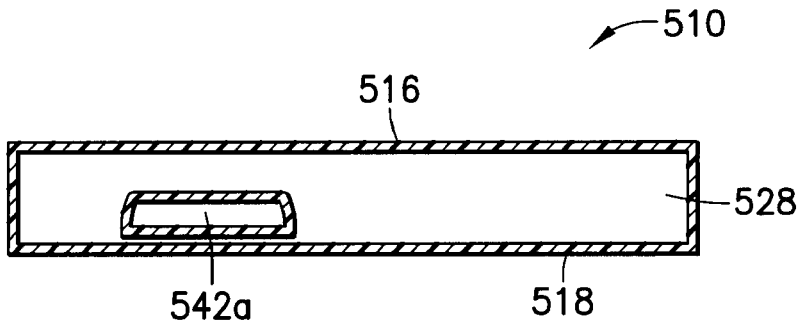
FIG. 6*f* is a cross-sectional view of the sixth embodiment of FIG. 6*a* taken along line 6*f*—6*f;*
Figure 6G:
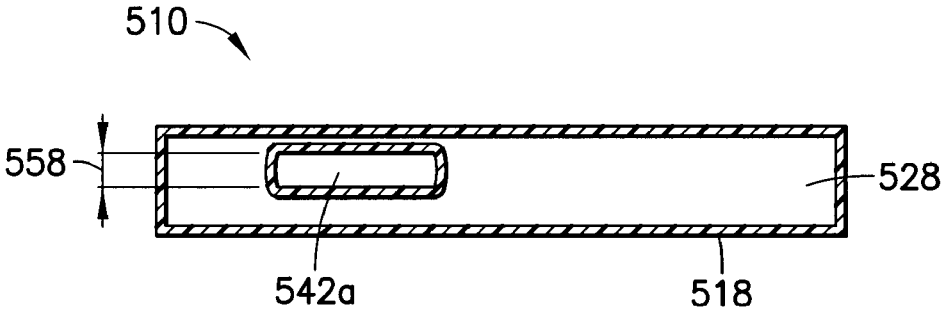
FIG. 6*g* is a cross-sectional view of the sixth embodiment of FIG. 6*a* taken along line 6*g*—6*g*.
Figure 6H:
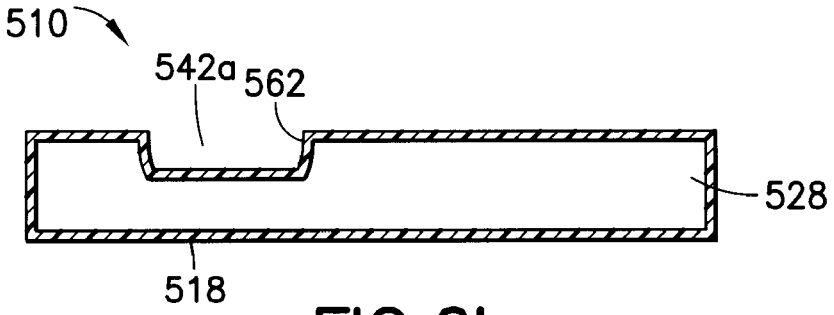
FIG. 6*h* is a cross-sectional view of the sixth embodiment of FIG. 6*a* taken along line 6*h*—6*h*.

Turning now to FIGS. 5*a*, 5*b*, and 5*c*, a fifth embodiment of a low profile speaker enclosure 410, which is substantially similar to the first embodiment, 10 (with like parts having reference numerals incremented by 400), is shown. In the fifth embodiment, the speaker housing 412 is substantially round and has a front face 416, a back 418, and only one side 424 which defines a first side aperture 432*a* and a second side aperture 432*b*. The front face 416, the back 418, and the side 424 substantially define a chamber 428. Further, the back 418 has a portion 436 which defines a channel 442 which opens onto both the first and second side apertures 432*a*, 432*b*. It will be appreciated that the speaker enclosure 410 may be formed having a side 424 which defines only one side aperture 432 or more than two side apertures (not shown) and having the channel 442 open to the one or more side apertures. An aperture 438 defined by a top of the back portion 436 provides an opening between the channel 442 and the chamber 428. The side apertures 432*a*, 432*b* provide ports between the channel 442 and an external environment 448.

Turning now to FIGS. 6*a*, 6*b*, 6*c*, 6*d*, 6*e*, 6*f*, 6*g*, and 6*h*, a sixth embodiment of a low profile speaker enclosure 510, which is substantially similar to the first embodiment 10 (with like parts having reference numerals incremented by 500), is shown. In the sixth embodiment, a channel 542 formed at least partially by the back wall 518 is coupled to a channel extension or tube 542*a* which extends through the speaker enclosure 510. The channel 542 and the channel extension 542*a* form a pathway between the back aperture 538 which opens to the chamber 528 and a front aperture 562 defined by the front face 516. The tube 542*a* of the sixth embodiment preferably maintains a constant width 556 and preferably gradually expands in height 558 at least partially along its length 554. Further, the front aperture 562 is preferably formed as an oval, although it may instead be formed in other shapes.

There have been described and illustrated herein several embodiments of a low profile speaker enclosure. While particular embodiments of the invention have been described, it is not intended that the invention be limited thereto, as it is intended that the invention be as broad in scope as the art will allow and that the specification be read likewise. Thus, while particularly shaped housings have been disclosed, it will be appreciated that cross-sections through the housing may take other shapes as well including but not limited to, quadrilateral, oval, circular, octagonal, and other regular shapes as well as irregular shapes. Further, while a speaker enclosure having a channel forming a port between a chamber and an aperture on one side of the enclosure was disclosed, it will be understood that the channel could also provide a pathway between the chamber and apertures formed on two sides of the enclosure such as at a corner of the enclosure or between the chamber and separately formed apertures on two or more side faces. Also, while the channels shown have been generally linear, with or without undulations, it will be appreciated that the channel can curve along its length and/or width, and/or height. It is understood that the side aperture and the back aperture need not be identically shaped or sized and either or both may be non-circular. Further, it will be appreciated that the back aperture may be formed at any position on the back such that the back aperture provides an opening between the chamber and the channel. Also, while a housing having a front face and back portion which are substantially parallel is preferred, it will be recognized that the front face and back portion need not be parallel. Furthermore, while the sides are shown such that opposing sides are parallel, it will be understood that non-parallel opposing sides can be similarly used. Still further, while it was disclosed that the length and width of the front face are substantially the same as the length and width of the back, it will be appreciated that the front face and back need not be formed having the same size length and width. In addition, while a particular type of electroacoustical transducer has been disclosed, it will be understood that other types of transducers can be used instead; for example, and not by way of limitation, membrane speakers. Also, multiple drivers can be used within a single enclosure. Moreover, while particular configurations have been disclosed in reference to the location of the electroacoustical transducer and the channel, it will be appreciated that other configurations could be used as well. Furthermore, while the channel is shown formed having its major axis along the longer of the length and width of the housing, it will be appreciated that the axis of the chamber may instead be formed along the shorter of the two. Likewise, while the side aperture is shown formed on a side corresponding to the shorter of either the length or width, it will be understood that the side aperture may instead be formed on a side corresponding to the longer of the two. It will therefore be appreciated by those skilled in the art that yet other modifications could be made to the provided invention without deviating from its spirit and scope as claimed.

What is claimed is:

1. A speaker enclosure for mounting upon a structure, comprising:

a) a speaker housing having a front face, a back separated from said front face, and a plurality of sides, said front face, said back, and said plurality of sides of said speaker housing defining a chamber, said front face defining a speaker aperture which opens into said chamber, at least one of said plurality of sides defining a side aperture, said back having a first portion and a second portion and defining a back aperture therebetween opening into said chamber, said second portion substantially defining a channel, said back aperture and said side aperture opening into said channel, the structure at least partially enclosing said channel and providing a pathway between said chamber and an external environment; and b) an electroacoustical transducer mounted in said speaker aperture.

2. A speaker enclosure according to claim 1, wherein:

at least one of said front face and said back define a length and a width of said housing, and said plurality of sides substantially defining a thickness of said housing, said thickness being substantially less than one of said length and said width.

3. A speaker enclosure according to claim 2, wherein;

at least one of said speaker housing length and width is at least ten times greater than said thickness.

4. A speaker enclosure according to claim 2, wherein;

each of said speaker housing length and width is at least five times greater than said thickness, and said thickness of said speaker housing is between 0.25 inches and 4.0 inches.

5. A speaker enclosure according to claim 1, wherein:

said front face has a substantially curvilinear form.

6. A speaker enclosure according to claim 1, wherein:

said channel is substantially u-shaped.

7. A speaker enclosure according to claim 1, wherein:

said channel has a substantially undulating form.

8. A speaker enclosure according to claim 1, wherein:

said side aperture is non-circular.

9. A speaker enclosure according to claim 1, wherein:

said back aperture is non-circular.

10. A speaker enclosure according to claim 1, wherein:

said front face, back, and plurality of sides of said speaker housing are integrally formed.

11. A speaker enclosure according to claim 1, wherein:

said first portion of said back is substantially planar.

12. A speaker enclosure according to claim 1, wherein:

said front face is substantially formed along a first plane, said first portion of said back is substantially formed along a second plane, said second portion of said back lying in a plane outside either of said second plane and said first plane, and said second plane is substantially parallel to said first plane.

13. A speaker enclosure according to claim 1, wherein:

said front face has a plurality of undulations.

14. A speaker enclosure according to claim 1, further comprising:

c) a mounting means, said mounting means for securing said speaker enclosure to said structure.

15. A speaker enclosure for mounting upon a structure, comprising:

a) a speaker housing having a front face, a back separated from said front face, and at least one side, said front face, said back, and said at least one side of said speaker housing substantially defining a chamber, said front face defining a speaker aperture which opens into said chamber, said back substantially defining a channel and defining a back aperture opening both into said chamber and into said channel, at least one of said at least one side and said front face defining at least one sound port opening into said channel, the structure at least partially enclosing said channel and providing a pathway between said chamber and an external environment; and b) an electroacoustical transducer mounted in said speaker aperture.

16. A speaker enclosure according to claim 15, wherein:

at least one of said front face and said back define a length and a width of said housing, and said at least one side substantially defining a thickness of said housing, said thickness being substantially less than one of said length and said width.

17. A speaker enclosure according to claim 15, further comprising:

c) a tube extending from said channel to said front face sound port.

18. A speaker enclosure according to claim 15, wherein:

said at least one side defines two side sound ports which open into said channel.

19. A speaker enclosure according to claim 15, wherein:

said back aperture is defined by a top of said channel.

20. A speaker enclosure for mounting upon a structure, comprising:

a) a speaker housing having a front face, a back separated from said front face, and at least one side, said front face, said back, and said at least one side of said speaker housing defining a chamber, said front face defining a speaker aperture which opens into said chamber, said front face having a plurality of undulations, said back substantially defining a channel defining a back aperture opening into both said chamber and said channel, at least one of said at least one side and said front face defining at least one sound port opening into said channel, the structure at least partially enclosing said channel and providing a pathway between said chamber and an external environment; and b) an electroacoustical transducer mounted in said speaker aperture.

21. A method of forming a speaker port, comprising:

a) acquiring a speaker enclosure having a housing and an electroacoustical transducer, said housing having a front face, a back separated from said front face, and at least one side, said front face, said back and said at least one side at least partially defining a chamber, said back substantially defining a channel and defining a back aperture, said back aperture opening into both said chamber and said channel, at least one of said at least one side and said front face defining a sound port providing an opening between said channel and an external environment; and b) coupling said low profile speaker enclosure to a structure such that said structure at least partially encloses said channel.

22. A speaker enclosure for mounting upon a structure, comprising:

a) a speaker housing having a front face and a back each substantially defining a length and a width of said housing, and at least a first side substantially separating said front face and said back and at least partially defining a thickness of said speaker housing, said thickness being substantially less than one of said length and said width, said front face, said back, and said at least one side of said speaker housing substantially defining a chamber, said front face defining a speaker aperture which opens into said chamber, at least one of said side and said front face defining a sound port, said back substantially defining a channel and a back aperture, said back aperture and said sound port opening into said channel, the channel being at least partially enclosed by the structure;

b) an electroacoustical transducer mounted in said speaker aperture; and c) a mounting means, said mounting means for securing said speaker enclosure to said structure.

* * * * *